United States Patent [19]

Langenbeck et al.

[11] Patent Number: 4,949,531

[45] Date of Patent: Aug. 21, 1990

[54] SYSTEM FOR PACKING CONTAINERS INTO TRAYS

[75] Inventors: Keith A. Langenbeck, 4005 University Blvd., Dallas, Tex. 75205; Andrew P. Devine; Joseph M. Howsden, both of Oklahoma City, Okla.

[73] Assignee: Keith A. Langenbeck, Dallas, Tex.

[21] Appl. No.: 186,157

[22] Filed: Apr. 26, 1988

[51] Int. Cl.[5] ..... B65B 5/10; B65B 35/44

[52] U.S. Cl. ..... 53/534; 53/251

[58] Field of Search ..... 53/244, 249, 250, 251, 53/534; 198/431

[56] References Cited

U.S. PATENT DOCUMENTS

| | | | |
|---|---|---|---|
| 3,314,213 | 4/1967 | Peppler | 53/534 X |
| 3,331,184 | 7/1967 | Kraus | 53/250 X |
| 3,332,200 | 7/1967 | Englander | 53/244 X |
| 3,377,774 | 4/1968 | Nigrelli et al. | 53/534 X |
| 3,481,108 | 12/1969 | Englander et al. | 53/534 |
| 3,572,005 | 3/1971 | Allen | 43/534 |
| 3,601,952 | 8/1971 | Cato | 53/534 X |
| 3,805,478 | 4/1974 | Stohlquist et al. | 53/534 X |
| 4,531,345 | 7/1985 | Nigrelli et al. | 53/534 |

FOREIGN PATENT DOCUMENTS 1433134 6/1989 United Kingdom .

*Primary Examiner*—John Sipos

*Assistant Examiner*—Beth Bianca

*Attorney, Agent, or Firm*—W. Kirk McCord

[57] ABSTRACT

A system for packing containers into trays for transport and/or storage. First and second conveyor tracks are provided for transporting the containers and the trays, respectively, along substantially the same transport axis. The second track is disposed beneath the first track and is inclined upwardly so that the first and second tracks converge at a predetermined location adjacent to the downstream end of the first track. The inclined portion of the second track includes a flexible spring member, which cooperates with a guide member positioned on an undersurface of the first track to position each tray as it moves along the inclined portion of the second track so that the leading end of each tray clears the downstream end of the first track. Positioned downstream of the first and second tracks is a support member for journally supporting at least a portion of each tray as the containers are being packed into that particular tray. The support member is pivotally mounted for being moved downwardly away from the downstream end of the first track by the weight of the packed tray to provide sufficient clearance for the trailing end of the tray to clear the downstream end of the first track when the packing operation is completed. As the packed tray moves downstream on the support member, the support member will be moved upwardly by a spring-bias to return to its original position for supporting the next packed tray in sequence.

9 Claims, 9 Drawing Sheets

SYSTEM FOR PACKING CONTAINERS INTO TRAYS

FIELD OF THE INVENTION

The present invention relates generally to tray packing systems and in particular to a system and method for packing articles, such as beverage containers, into trays for transport and/or storage.

BACKGROUND OF THE INVENTION

Beverages, such as soft drinks and beer, are distributed commercially in glass and plastic bottles and in aluminum cans. Single service beverage containers, which typically contain six to twenty-four ounces of the beverage, are usually grouped into individual cases, each usually containing twenty-four individual containers. These cases may be further subdivided into groups of six, eight or twelve individual beverage container packages. Typically, each case of beverage containers is loaded into a separate tray for transport from the site of a bottling/canning company to the point of sale, such as at a grocery store.

DESCRIPTION OF THE PRIOR ART

Automated systems for loading individual beverage containers into trays for transport and storage are known in the art. According to prior practice, such automated systems typically fall into one of the following three categories: (1) tray former loader systems; (2) vertical drop/set packer systems; and (3) ski packer systems. All such systems rely on synchronization between the movement of the individual cans or bottles on a first conveyor track with the movement of the individual trays into which the cans or bottles are to be packed on a second conveyor track. Various types of tray packing systems are described in U.S. Pat. Nos. Re: 25,852; 3,354,613; 3,478,491; 599,397; 4,389,832; 4,391,078; and 4,578,930 and in British Patent No. 1,433,134.

An improvement over typical prior art tray packing systems is shown and described in U. S. Pat. No. 4,704,841 and in pending Patent application Ser. No. 076,389, filed July 22, 1987, both of which are owned by the assignee of record in this application. U.S. Pat. No. 4,704,841 and application Ser. No. 076,389 teach beverage tray packing systems, which are comprised of a first conveyor track in which the containers are transported and a second conveyor track on which the trays are transported. A portion of the second conveyor track is inclined with respect to the first conveyor track so that the first and second tracks converge at a predetermined location. In U.S. Pat. No. 4,704,841 a packing ramp is pivotally mounted at the downstream end of the first track adjacent to the predetermined location at which the two tracks converge. The packing ramp is moved upwardly to an inclined position when the ramp is in contact with either the leading or the trailing edge of a tray. In application Ser. No. 076,389 the packing ramp is replaced by a reciprocating support member to introduce the containers into the tray. The containers are packed into the tray in sequence from the leading edge to the trailing edge of the tray while the tray is on the inclined portion of the second track.

Although the beverage tray packing systems described in U.S. Pat. No. 4,704,841 and Application Ser. No. 076,389 are a significant improvement over prior art beverage tray packing systems, the speed of operation of the systems is limited by the cycle time of the packing ramp and the support member. Furthermore, the packing ramp is lifted upwardly by the leading and trailing edges of the tray, which necessitates the use of relatively rigid trays in order to effect the necessary lifting action.

OBJECTS OF THE INVENTION

It is, therefore, the principal object of the present invention to provide an improved system for packing containers into trays for transport and/or storage.

Another object of the invention is to enhance the speed of operation of a beverage tray packing system.

Still another object of the invention is to provide a beverage tray packing system in which relatively non-rigid as well as rigid trays can be used.

SUMMARY OF THE INVENTION

These and other objects are accomplished in accordance with the present invention wherein a system for packing a containers into a corresponding tray is comprised of first conveyor means for transporting said containers along a first track, second conveyor means for transporting the tray along a second track, at least a portion of the second track being inclined with respect to the first track so that the second track converges toward the first track, guide means positioned between the first track and the inclined portion of the second track, means for urging the tray into contact with the guide means as the tray is transported along the inclined portion of the second track so that a leading end of the tray clears the downstream end of the first track and support means positioned downstream of the first track for journally supporting at least a portion of the tray as the tray is transported past the downstream end of the first track.

In one aspect of the invention the support means is moveable in a first direction to provide sufficient clearance for the tray to clear the downstream end of the first track and in a second direction, opposite from the first direction, to position the tray substantially horizontally after the containers have been packed therein. In one embodiment, the support means is pivotally mounted for rotation about an axis extending transversely relative to a downstream axis. The support means is comprised of a first member which is upstream of the transverse axis and a second member which is downstream of the transverse axis. The support means is pivoted by the weight of the tray acting on the first member so that the first member is moved downwardly and away from the downstream end of the first track and the second member is moved upwardly when the support means is pivoted in the first direction. In another embodiment the support means is spring-biased for rotating the support means in the second direction when the tray is supported substantially by the support means. In the preferred embodiment first stop means is provided for engaging the first member to limit the downward movement of the first member and the upward movement of the second member when the support means is rotated in the first direction and second stop means is provided for engaging the second member to limit the downward movement of the second member and the upward movement of the second member when the support means is rotated in the second direction. The first member includes a downwardly extending lip portion for providing a ramp for the tray to climb onto the support means as the tray is moved Past the downstream end of the first track.

In another aspect of the invention, the urging means is comprised of a flexible spring member for contacting the bottom surface of the tray to urge the tray in the direction of the guide means so that an upper edge of the tray is in contact with the guide means. In one embodiment the spring member is biased so that it converges toward the guide means in a downstream direction. The tray acts on the spring member to separate the spring member from the guide means sufficiently to allow the tray to be moved therebetween. The spring member contacts the bottom surface of the tray to maintain the upper edge of the tray in contact with the guide means.

In yet another aspect of the invention the guide means includes first, second and third inclined surfaces in facing relationship with the urging means. The first inclined surface extends in a downstream direction from a first position to a second position, the second inclined surface extends in the downstream direction from the second position to a third position and the third inclined surface extends in the downstream direction from the third position substantially to the downstream end of the first track. The distance between the second position and the downstream end of the first track is less than the distance between the leading and trailing ends of the tray so that the leading end of the tray clears the downstream end of the first track before the trailing end of the tray passes the second position. In one embodiment the movement of the trailing end of the tray past the second posItIon results in a relative abrupt movement of the trailing end of the tray from the second position to the third position and of the leading end of the tray outwardly from the downstream end of the first track to position the tray for receiving the containers. In the preferred embodiment the second inclined surface extends upwardly and downstream at a predetermined obtuse angle relative to the first inclined surface and the third inclined surface extends upwardly and downstream at substantially said predetermined obtuse angle relative to the second inclined surface, so that the first and third inclined surfaces are substantially parallel.

BRIEF DESCRIPTION OF THE DRAWINGS

Other objects and advantages of the invention will be apparent from the detailed description and claims when read in conjunction with the accompanying drawings wherein:

DETAILED DESCRIPTION OF THE PREFERRED EMBODIMENT

In the description which follows, like parts are marked throughout the specification and drawings, respectively. The drawings are not necessarily to scale and in some instances proportions have been exaggerated in order to more clearly depict certain features of the invention.

Figure 1:
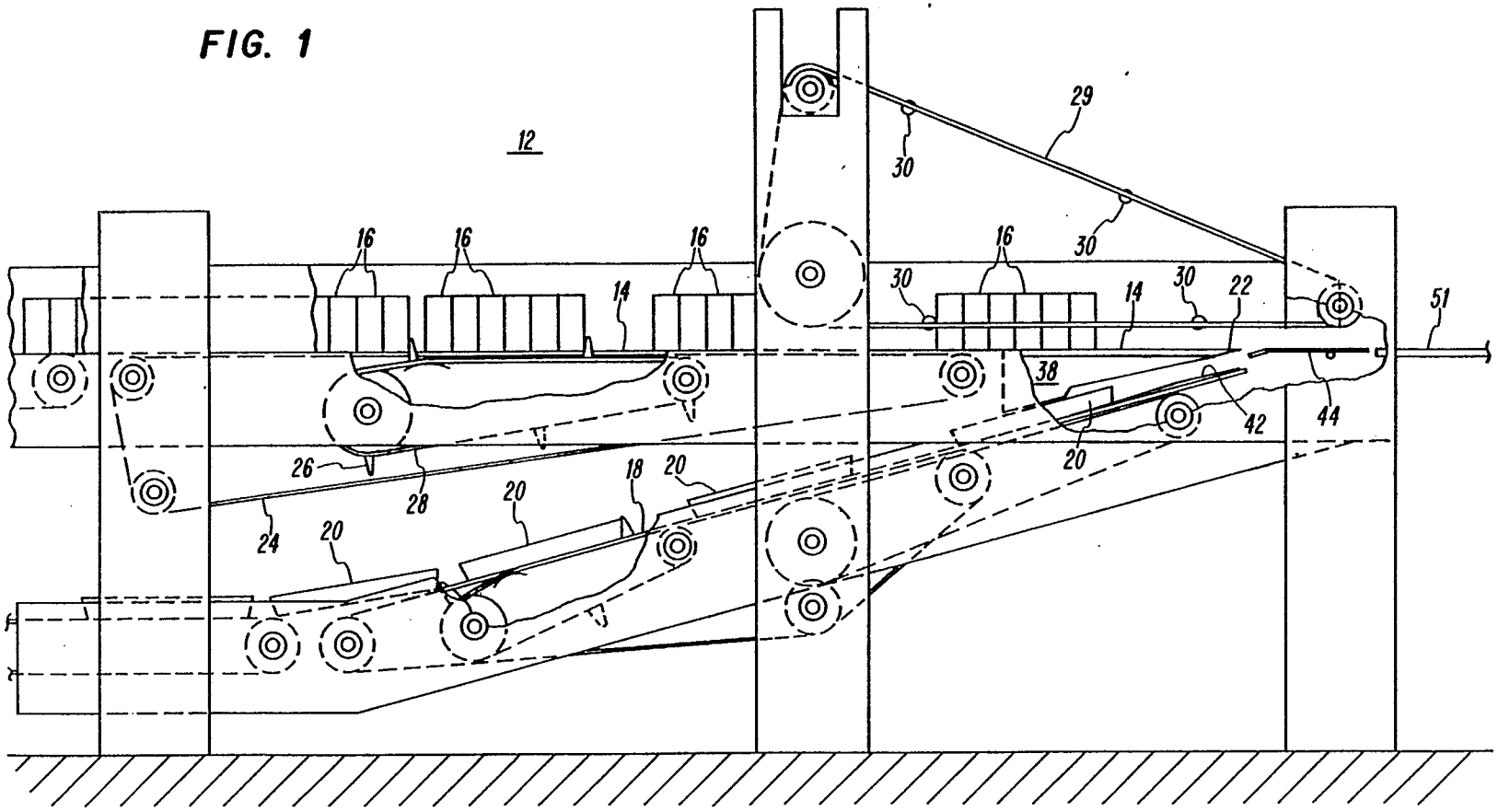
FIG. 1 is a side elevation view of a tray packing system according to the present invention.

Referring to FIG. 1, an automated system for packing articles, such as beverage containers, into trays for transport and/or storage according to the present invention is depicted. Packing system 12 includes a first conveyor track 14 on which individual beverage containers 16 are transported in a downstream direction (left to right as viewed in FIG. 1). Containers 16 may be pre-packaged into six-packs, eight-packs, or twelve-packs, or alternatively, individual containers 16 may be transported in a loose state on first conveyor track 14. A second conveyor track 18 for transporting trays 20 is located beneath first track 14 and is inclined upwardly toward first conveyor track 14 so that first and second tracks 14 and 18 substantially converge adjacent to a downstream end 22 of first conveyor track 14.

An upstream portion of first track 14 is comprised of a first chain drive 24 for transporting containers 16 in the downstream direction. Dividers 26 are driven by a second chain drive 28 for engaging containers 16 from beneath first track 14 to separate containers 16 into groups of a predetermined number of containers 16. For example, twenty-four individual containers 16 corresponding to a standard case of beverage containers 16 may comprise each group. The procedure by which containers 16 are divided into groups is described in detail in U.S. Pat. No. 4,704,841, which is incorporated herein by reference. As containers 16 continue downstream on first track 14, a third chain drive 29 having a plurality of flight bars 30 extending therefrom engages containers 16 to impart the motive force to containers 16 by means of flight bars 30, as described in detail in U.S. Pat. No. 4,704,841.

Figure 2A:
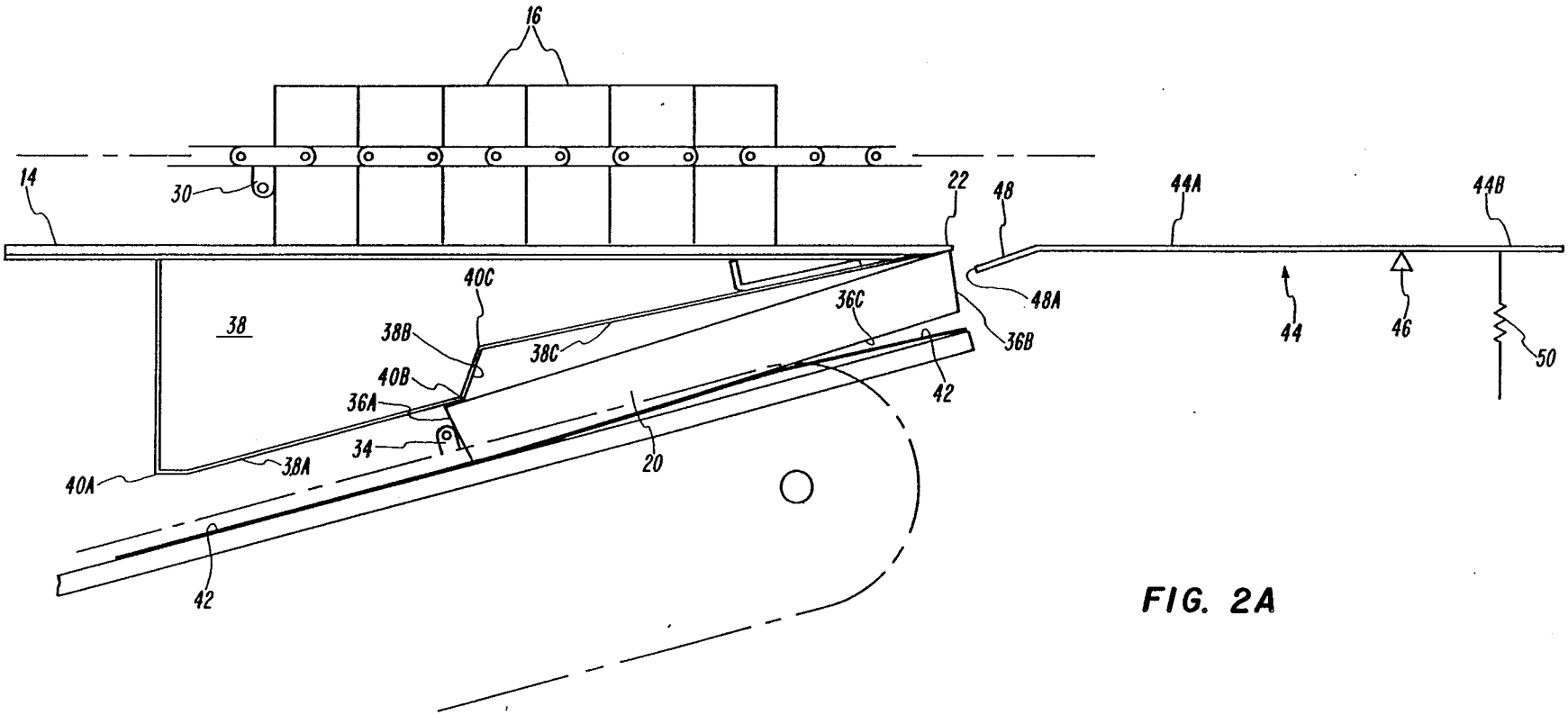
FIGS. 2A–2G are respective side elevation views of a portion of the tray packing system of FIG. 1 showing the successive steps in which containers are loaded into trays.
Figure 2B:
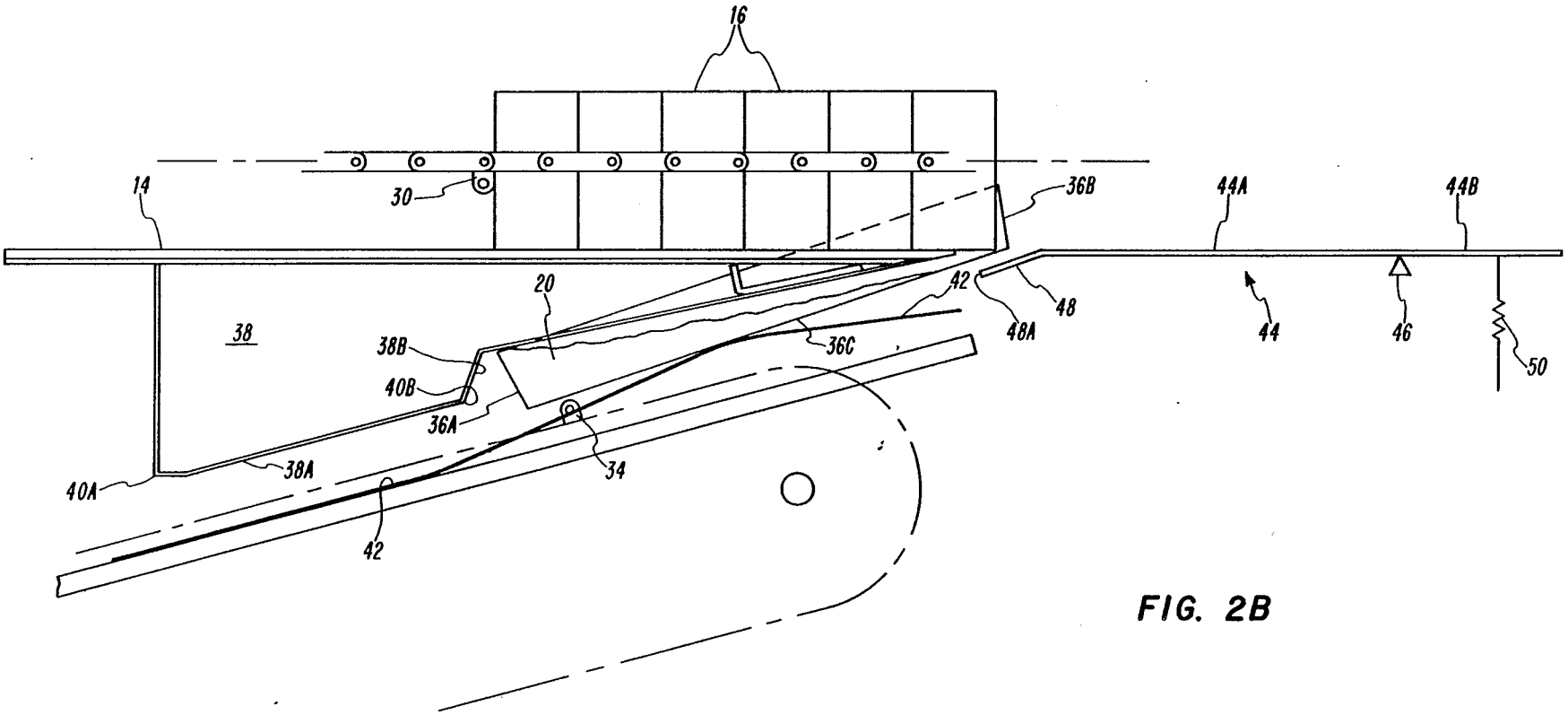
Figure 2C:
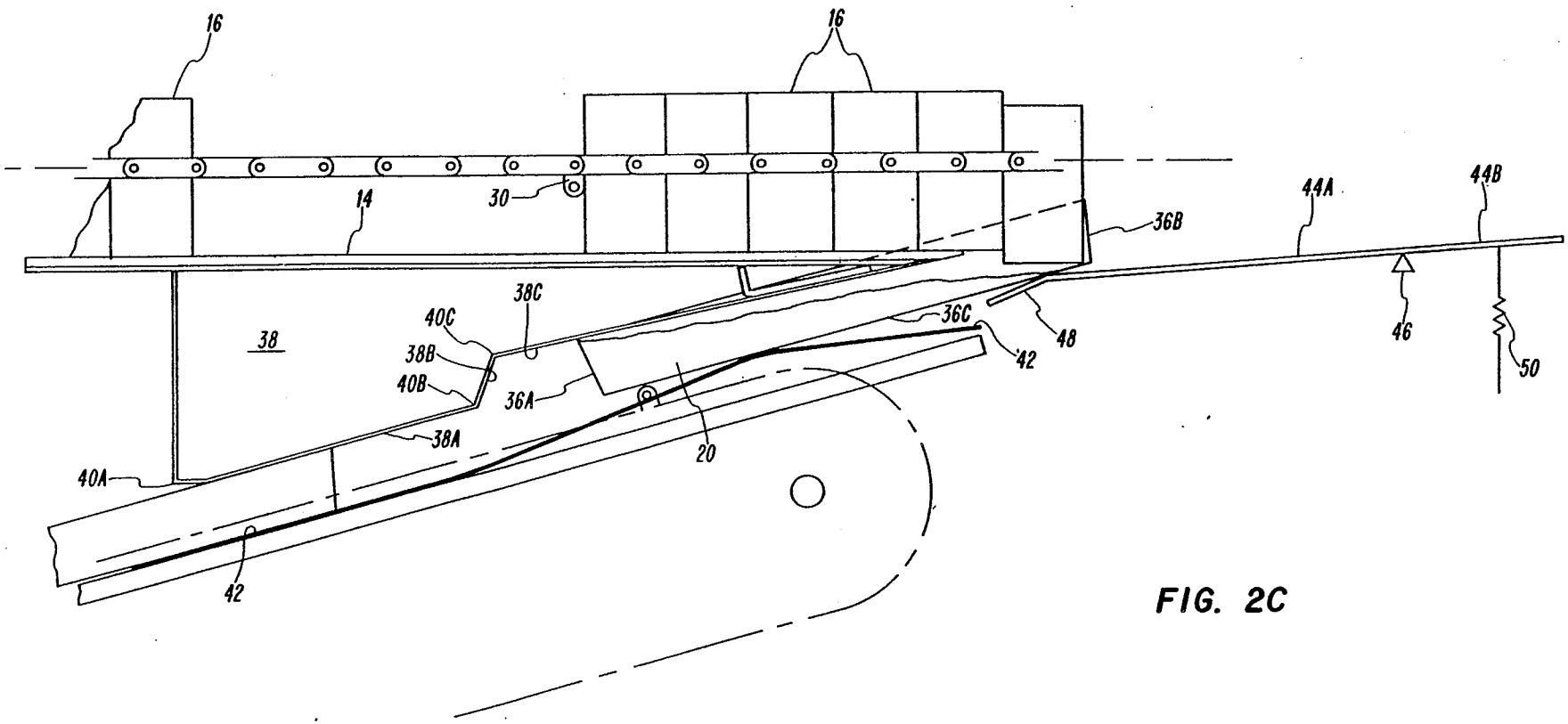
Figure 2D:
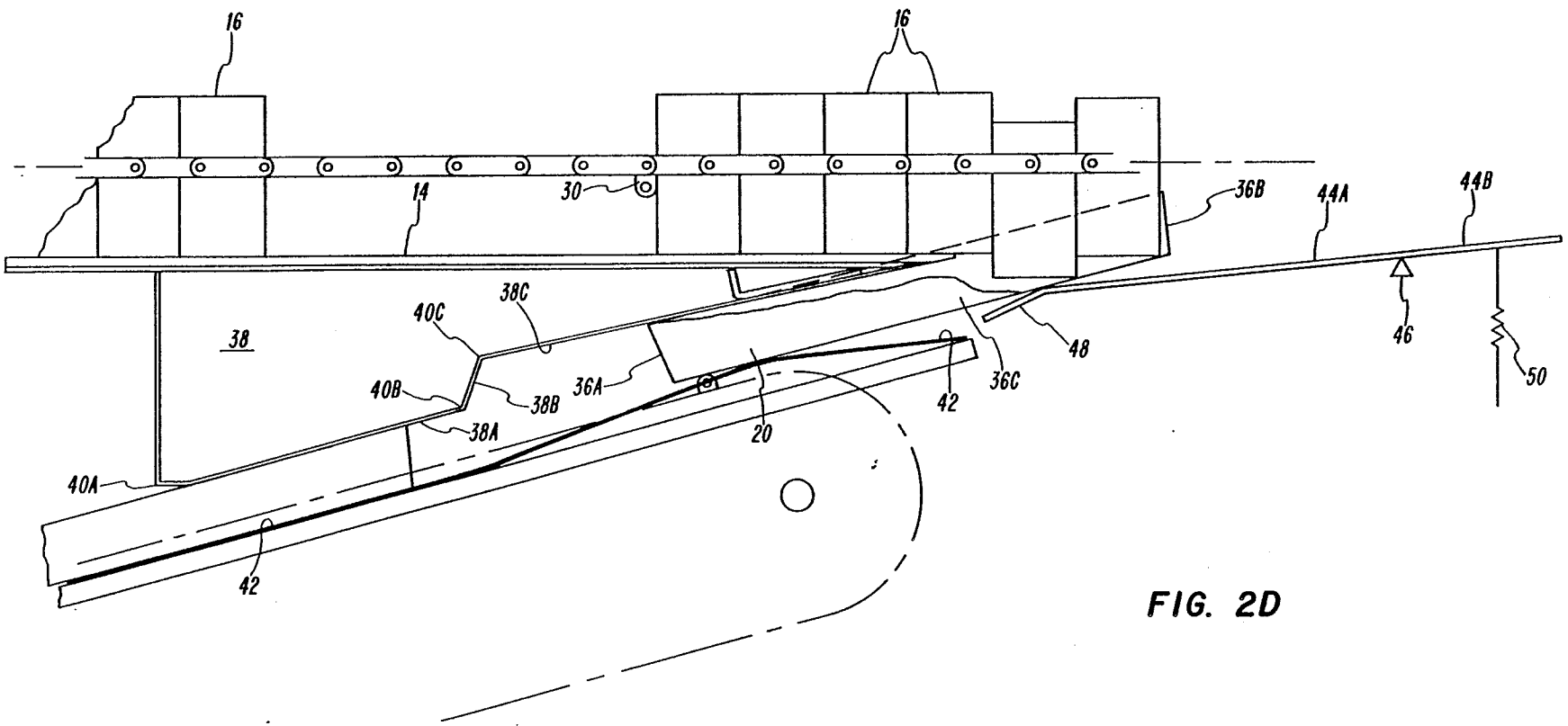
Figure 2E:
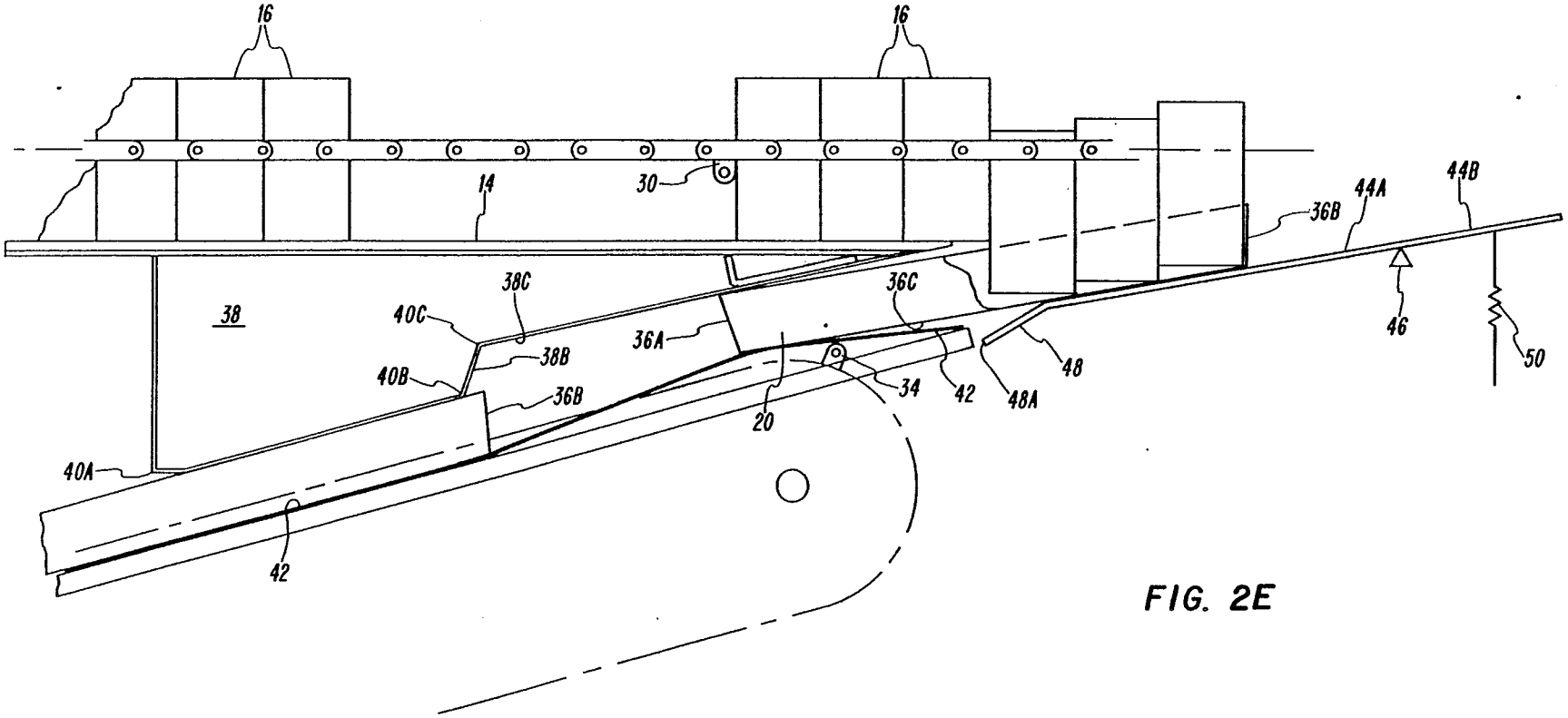
Figure 2F:
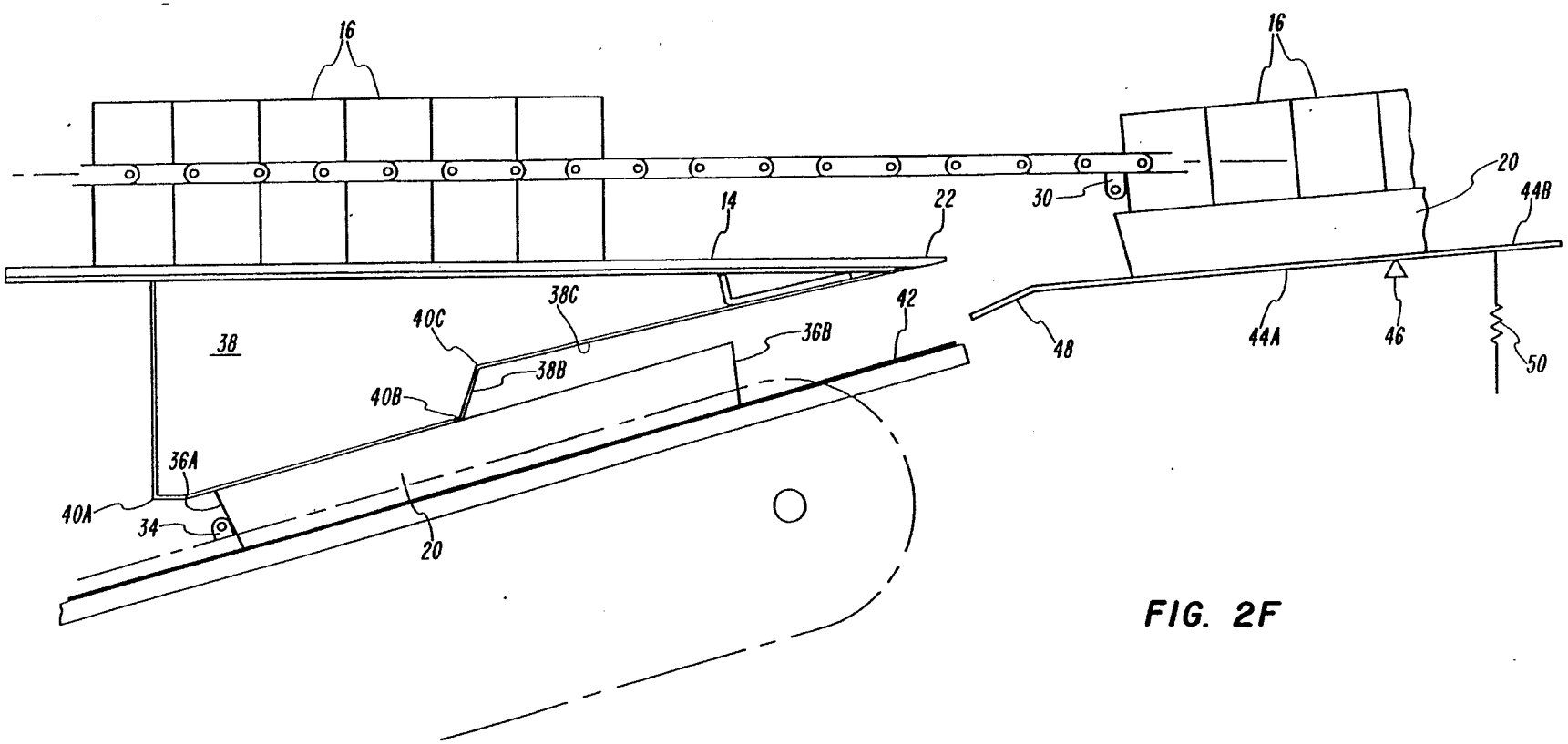
Figure 2G:
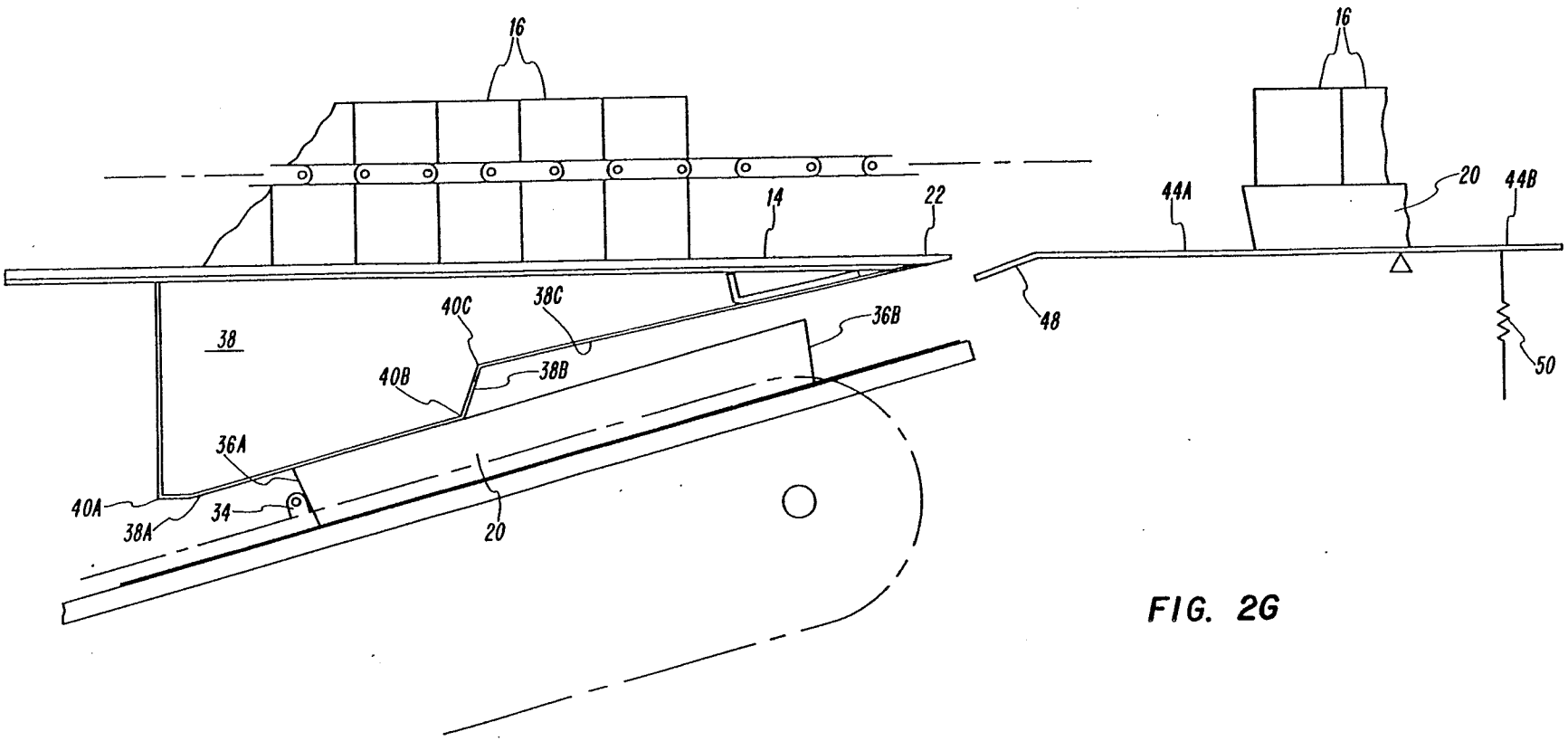
Figure 3:
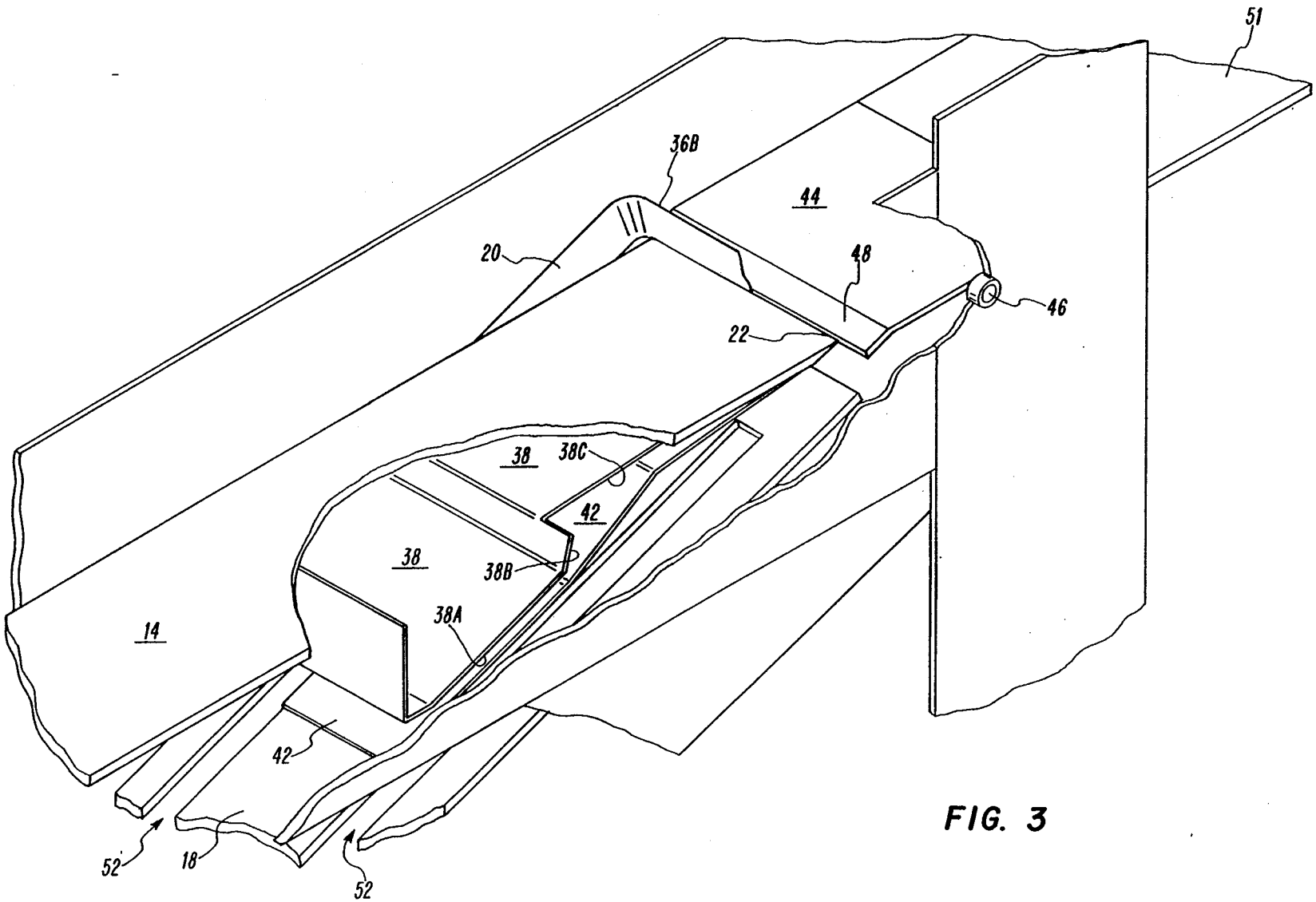
FIG. 3 is a perspective, partial cutaway view of a portion of the tray packing system according to the present invention, showing a tray in position for receiving a group of containers.

Referring also to FIGS. 2–3, each tray 20 is moved along second track 18 by projections 34, which engage a trailing end 36A of each tray to propel each tray 20 along inclined second track 18. Disposed beneath first track 14 is a guide member 38 having a lower major surface which is in facing relationship with second track 18. The lower major surface of guide member 38 is comprised of first surface 38A, second surface 38B and third surface 38C. First surface 38A extends from a first position 40A, which is substantially upstream from downstream end 22 to a second position 40B, which is downstream of first position 40A. Second surface 38B extends upwardly and downstream from second position 40B to a third position 40C, which is downstream of second position 40B. Third surface 38C extends upwardly and downstream from third position 40C substantially to downstream end 22. First and second surfaces 38A and 38B intersect at a predetermined obtuse angle and second and third surfaces 38B and 38C intersect at substantially the same obtuse angle. As best seen in FIG. 3, first and second surfaces 38A and 38B are wider than third surface 38C along an axis which is transverse relative to the downstream axis and are of substantially the same or greater width than each tray 20 to keep trays 20 below guide member 38. The width of third surface 38C is substantially the same as first track 14 at downstream end 22 and is less than the width of each tray 20 so that each tray 20 can move upwardly when leading end 36B of the tray clears downstream end 22.

Disposed on second track 18 is a flexible leaf spring member 42, the spring bias of which causes spring member 42 to converge toward guide member 38 in a downstream direction. Positioned downstream of first track 14 is a support member 44, which is pivotally mounted along an axis 46 which is transverse to the upstream-downstream axis so that a first portion 44A of support member 44 is positioned upstream of pivot axis 46 and a second portion 44B is positioned downstream of pivot axis 46. First portion 44A includes a downwardly extending lip 48 having an upstream end 48A which is disposed beneath downstream end 22 of first track 14 to provide a ramp for tray 20 to climb onto support member 44 as tray 20 is moved downstream beyond downstream end 22. The remainder of first portion 44A, which is downstream of lip 48, is substantially flat and is at substantially the same level as first track 14 when support member 44 is in a substantially horizontal position shown in FIG. 2A. Support member 44 is maintained in the position shown in FIG. 2A by a tension spring 50, which acts on second portion 44B to exert a torque on support member 44 in a clockwise direction, as viewed from the perspective of FIG. 2A. A first stop member (not shown) is provided for limiting the clockwise rotation of support member 44 so that support member 44 is maintained in a substantially horizontal position as shown in FIG. 2A when no tray 20 is being supported thereby. A third conveyor track 51 is disposed downstream of support member 44 for transporting packed trays 20 downstream to their next destination.

In FIG. 2A leading end 36B of tray 20 has just cleared downstream end 22. The length of tray 20, as measured between the upper edge of trailing end 36A and the lower inside edge of leading end 36B, is greater than the distance between second position 40B and downstream end 22. As such, trailing end 36A will not have cleared second position 40B at the time that leading end 36B clears downstream end 22, as depicted in FIG. 2A. Concurrently, containers 16 are being moved downstream on first track 14, but the leading row of containers 16 has not reached downstream end 22 because tray 20 is not yet in position for receiving containers 16.

As best seen in FIG. 3, the inside width of each tray 20, as measured transversely with respect to the length thereof, is greater than the width of first track 14 and third surface 38C of guide member 38, so that when leading end 36B clears downstream end 22, leading end 36B will move abruptly upward and downstream end 22 will be received within the enclosure formed by the walls of tray 20. Shortly after leading end 36B has cleared downstream end 22, trailing end 36A will pass second position 40B, which will result in an abrupt upward movement of trailing end 36A between second position 40B and third position 40C. At this juncture, projection 34 moves downward through slots 52 and out of engagement with trailing end 36A and the movement of tray 20 is momentarily halted until the leading row of containers 16 engages the inside surface of leading end 36B. The upward movement of trailing end 36A from second position 40B to third position 40C will result in a downstream movement of leading end 36B away from downstream end 22 by a distance which is substantially the same as the separation between second and third positions 40B and 40C along the downstream axis. When the downstream movement of leading end 36B has occurred, tray 20 is positioned for receiving containers 16. As the corresponding group of containers 16 continues its downstream movement, the momentum imparted to tray 20 by the moving containers 16 will continue to move tray 20 downstream.

As best seen in FIGS. 2B–2E, containers 16 are loaded in sequence in succession from the leading to the trailing row of containers 16 while tray 20 is in an inclined position relative to first track 14. Spring member 42 contacts bottom surface 36C of tray 20 for urging tray 20 toward guide member 38 so that the upper edge of trailing end 36A is in contact with the lower major surface of guide member 38. The resiliency of spring member 42 is such that it is separated from guide member 38 by the action of tray 20 passing between guide member 38 and spring member 42. The spring action of spring member 42 imparts the abrupt upward movement of leading end 36B when leading end 36B clears downstream end 22 and of trailing end 36A when trailing end 36A clears second position 40B and cooperates with guide member 38 to properly position tray 20 for receiving the corresponding group of containers 16. As best seen in FIGS. 2B–2E, the spatial separation between third surface 38C of guide member 38 and spring member 42 is greatest in the vicinity of either trailing end 36A or leading end 36B because the respective upper edges of trailing end 36A and leading end 36B will be in contact with the lower major surface of guide member 38 as tray 20 is moved upwardly along second track 18. Because the width of tray 20 is greater than guide member 38, a portion of guide member 38 will be received within the enclosure formed by the walls of tray 20. FIGS. 2C–2E illustrate that the compression of spring member 42 by tray 20 will be greatest when either trailing end 36A or leading end 36B is in the vicinity of the central portion of spring member 42 to provide the maximum separation between spring member 42 and guide member 38.

FIGS. 2C–2E also illustrate the pivoting action of support member 44. As the leading row of containers 16 is packed into tray 20, the portion of tray 20 adjacent to leading end 36B will begin to bear on first portion 44A of support member 44, as shown in FIG. 2C. At this juncture the weight exerted by tray 20 and the leading row of containers 16 acts on first portion 44A in the vicinity of lip 48, which imparts a substantial torque to support member 44, thereby overcoming the spring-bias of tension spring 50 and causing support member 44 to rotate in a counterclockwise direction, as viewed from the perspective of FIGS. 2C–2E. This counterclockwise rotation will move lip 48 downwardly and away from downstream end 22 to provide sufficient clearance for tray 20 to continue its upward and downstream movement and in particular to allow trailing end 36A to clear downstream end 22. In accordance with the sequence depicted in FIGS. 2C–2E, the increasing weight exerted by tray 20 on first portion 44A as more containers 16 are packed into tray 20 will Pivot suPPort member 44 to its maximum extent in a counterclockwise direction, as shown in FIG. 2E. A second stop member (not shown) engages first portion 44A to limit the counterclockwise movement of support member 44. At this juncture approximately three of the six rows of containers 16 have been packed into tray 20. As tray 20 continues downstream, the remaining three rows of container 16 are packed and the center of gravity of the packed tray 20 will approach pivot axis 46, which reduces the torque exerted by the weight of the filled tray on support member 44 tending to pivot support member 44 counterclockwise. The spring-bias of tension spring 50 will also counteract the counterclockwise rotation of support member 44 and will begin to return support member 44 to its original position, as the center of gravity of tray 20 Passes pivot axis 46, by rotating support member 44 in a clockwise direction, as best shown in FIGS. 2F and 2G. In FIG. 2F, support member 44 is in the process of being rotated in a clockwise direction and in FIG. 2G, the clockwise rotation of support member 44 is substantially complete, such that support member 44 is returned to its substantially horizontal position with lip 48 just below downstream end 22 for receiving the next tray 20 in sequence. When support member 44 is returned to its original position, the next tray 20 in sequence is in position so that leading end 36B thereof is about to clear downstream end 22, whereupon the packing sequence depicted in FIGS. 2A–2G is repeated for the next tray 20.

In accordance with the present invention, packing speeds of greater than 100 cases (each containing approximately twenty-four containers) can be achieved. In addition, the packing operation can be conducted with relatively lightweight, non-rigid trays because substantial Pressures are not exerted on the walls of the tray. This is achieved by choosing a spring member which is sufficiently strong to maintain each tray in contact with the guide member as the tray travels upwardly along an inclined path and yet is sufficiently resilient to be separated from the guide member by the action of the tray without causing substantial stresses and pressures to be imparted to be imparted to the walls of the tray. The spring member is preferably chosen to match the weight and rigidity of the particular trays being used.

Various embodiments of the invention have now been described in detail. Since it is obvious that many changes in and additions to the above-described preferred embodiment can be made without departing from the nature, spirit and scope of the invention, the invention is not to be limited to said details, except as set forth in the appended claims.

What is claimed is:

1. A system for packing containers into a corresponding tray, comprising:

first conveyor means for transporting said containers along a first track;

second conveyor means for transporting said tray along a second track, at least a portion of said second track being inclined with respect to said first tract so that said second track converges toward said first track;

guide means positioned between the first track and the inclined portion of the second track;

means for urging said tray into contact with said guide means as said tray is transported along the inclined portion of the second track and for cooperating with the guide means to position said tray so that a leading end of said tray clears the downstream end of the first track, said guide means having first, second and third inclined surfaces in facing relationship with said urging means, said first inclined surface extending in said downstream direction from a first position to a second position, said second inclined surface extending upwardly and downstream at a predetermined obtuse angle relative to said first inclined surface from said second position to a third position, said second inclined surface being inclined with respect to a major surface of said first track, said third inclined surface extending upwardly and downstream from said third position to the downstream end of first track at substantially said predetermined obtuse angle relative to the second inclined surface, said first and said third inclined surfaces being substantially parallel, the distance between the second position and the downstream end of said first track being less than the distance between the leading and trailing ends of the tray, so that the leading end of the tray clears the downstream end of the first track before the trailing end of the tray passes the second position, the width of said tray along an axis transverse with respect to the direction of movement of the tray along the second track being greater than the respective widths of the third inclined surface of the guide means and the first track, as measured along an axis transverse with respect to the direction of movement of the containers along the first rack, such that when the leading end of the tray clears the downstream end of the first track, the leading end of the tray will move abruptly upward; and support means positioned downstream of said first track for journally supporting at least a portion of said tray as said tray is transported past the downstream end of the first track.

2. The system according to claim 1 wherein said movement of the trailing end of the tray past said second position results in a relatively abrupt movement of the trailing end of said tray upwardly and downstream from said second position to said third position and of the leading end of said tray outwardly from the downstream end of the first track to position the tray for receiving the containers.

3. The system according to claim 1 wherein said support means is moveable in a first direction to provide sufficient clearance for the tray to clear the downstream end of the first track and in a second direction, opposite from the first direction, to position the tray substantially horizontally after the containers have been packed therein.

4. The system according to claim 3 wherein said support means is pivotally mounted for rotation about an axis extending transversely relative to a downstream axis, said support means being comprised of a first member which is upstream of said transverse axis and a second member which is downstream of said transverse axis, said support means being pivoted by the weight of said tray acting on said first member so that said first member is moved downwardly and away from the downstream end of the first track and said second member is moved upwardly when said support means is pivoted in said first direction.

5. The system according to claim 4 wherein said first member is comprised of a substantially flat portion and a downwardly extending lip portion upstream of said flat portion, an upstream end of said lip portion being disposed beneath he downstream end of said first track to provide a ramp for said tray to climb onto said support means as said tray is moved downstream past the downstream end of the first track.

6. The system according to claim 1 wherein said urging means is comprised of a flexible spring member for contacting the bottom surface of the tray to urge the tray in the direction of said guide means so that an upper edge of said tray is in contact with said guide means.

7. The system according to claim 6 wherein said spring member is biased so that is converges toward said guide means in a downstream direction, said tray for acting on said spring member to separate said spring member from said guide means sufficiently to allow said tray to be moved between said guide means and said spring member, said spring member for contacting the bottom surface of the tray to maintain said upper edge of said tray in contact with said guide means when said tray is moved between said guide means and said spring member.

8. A system for packing containers into a corresponding tray, comprising:

first conveyor means for transporting said containers along a first track;

second conveyor means for transporting said tray along a second track, at least a portion of said second track being inclined with respect to said first track so that said second track converges towards said first track;

guide means positioned between the first track and the inclined portion of the second track;

means for urging said tray into contact with said guide means as said tray is transported along the inclined portion of the second track and for cooperating with the guide means to position said tray so that a leading end of said tray clears the downstream end of the first track, said guide means having first, second and third inclined surfaces in facing relationship with said urging means, said first inclined surface extending in said downstream direction from a first position to a second position, said second inclined surface extending upwardly and downstream from said second position to a third position at a predetermined obtuse angle relative to said first inclined surface, said second inclined surface being inclined relative to a major surface of said first track, said third inclined surface extending upwardly and downstream from said third position substantially to the downstream end of the first track at substantially said predetermined obtuse angle relative to the second inclined surface, said first and said third inclined surfaces being substantially parallel, the distance between the second position and the downstream end of the first track being less than the distance between the leading and trailing ends of the tray so that the leading end of the tray clears the downstream end of the first track before the trailing end of the tray passes the second position; and support means positioned downstream of said first track for journally supporting at least a portion of said tray as said tray is transported past the downstream end of the first track.

9. The system according to claim 8 wherein the movement of the trailing end of the tray past said second position results in a relatively abrupt movement of the trailing end of the tray upwardly and downstream from said second position to said third position and of the leading end of the tray outwardly from the downstream end of the first track to position the tray for receiving the containers.

* * * * *